United States Patent [19]

Kinzler

[11] 4,107,001

[45] Aug. 15, 1978

[54] HIGH PRESSURE WATER CLEANER FOR ASCENSION PIPES

[75] Inventor: Raymond Carl Kinzler, Carnegie, Pa.

[73] Assignee: Koppers Company, Inc., Pittsburgh, Pa.

[21] Appl. No.: 823,947

[22] Filed: Aug. 12, 1977

[51] Int. Cl.[2] ..... C10B 43/08

[52] U.S. Cl. ..... 202/241; 134/22 C; 134/24; 134/167 C; 201/2; 239/187

[58] Field of Search ..... 202/241; 239/184–187, 239/189, 227; 134/22 C, 24, 167 R, 167 C, 168 R, 168 C; 201/2

[56] References Cited

U.S. PATENT DOCUMENTS

| | | | |
|---|---|---|---|
| 1,796,878 | 3/1931 | Watson | 202/241 |
| 2,074,052 | 3/1937 | George | 239/227 |
| 3,556,948 | 1/1971 | Kinzler et al. | 202/241 X |
| 3,799,445 | 3/1974 | Marino | 239/227 X |
| 3,841,977 | 10/1974 | Stanke et al. | 202/241 |
| 3,880,359 | 4/1975 | Novy | 202/241 X |
| 3,892,250 | 7/1975 | Miko | 202/241 X |
| 4,013,518 | 3/1977 | Miko | 202/241 |

*Primary Examiner*—Morris O. Wolk
*Assistant Examiner*—Roger F. Phillips
*Attorney, Agent, or Firm*—Thomas L. Sivak; Oscar B. Brumback

[57] ABSTRACT

A cleaner for ascension pipes is mounted onto a carriage that is movable on top of a coke oven battery alongside ascension pipes of coke oven chambers in the battery. The cleaner includes a flexible member, anchored at one end to the carriage, and carrying, at the other end, a nozzle block and nozzles. The flexible member is supported by rotatable members, pivotally mounted to the carriage, with one rotatable member being power driven. Means is provided for pivoting the arm to which the powered rotatable member is mounted.

The flexible member supports a flexible fluid-carrying hose that connects to the nozzle block and that carries fluid to the nozzles mounted therein. By actuating the power driven rotatable member, the nozzle block and nozzles are reciprocable in the ascension pipes and fluid carried in the hose washes encrusted material from the inner surface of the ascension pipes.

7 Claims, 7 Drawing Figures

HIGH PRESSURE WATER CLEANER FOR ASCENSION PIPES

BACKGROUND OF THE INVENTION

1. Field of the Invention

The present invention relates to coke oven batteries generally and, more particularly, to apparatus for cleaning standpipes or ascension pipes of the coke oven chambers of a coke oven battery.

2. Description of the Prior Art

The usual coke oven chamber is equipped with one or two ascension or standpipes that carry away the volatile products liberated from coal that is being coked in each respective coke oven chamber. The volatile products, in the form of gases, emerge from the oven chamber at one or both ends thereof, and flow upwardly, in the ascension or standpipes, and thence into one or both collecting mains that run along the top sides of the coke oven battery.

In flowing upwardly in an ascension pipe or standpipe into the collecting main the gases traverse a gooseneck-type of elbow and change direction of flow. Because the ascension or standpipe is above the top of the coke oven chamber, the walls of the ascension or standpipe, even though they are refractory lined, are cooler than the gases emerging from the oven chamber. Thus, some condensate matter is deposited on the refractory lining of the ascension or standpipe. In time, the deposited matter becomes excessive, and it is necessary to remove the encrusted matter. Such deposited matter is carbonaceous in character and, unless removed, may in time plug the ascension pipe.

Heretofore, mechanical scraping means has been used to remove such encrusted matter from the ascension or standpipe. Such encrusted material is usually in the form of heavy and hard deposits of carbon that may become particularly thick and difficult to remove, particularly in the vicinity of the top of the ascension or standpipe, where the gooseneck elbow is joined to it.

Presently, the removal of the deposited material from the interior of the ascension or standpipe is performed manually by an operator using a long tool that chips away the encrusted material. Such manual work is time consuming, arduous and dangerous work, because the temperature in the neighborhood of the ascension or standpipe, particularly at the opening in the gooseneck elbow, is usually in the range of 500°-800° C.

Several types of mechanical scraper devices have been proposed, and are known from the prior art, that clean the gooseneck elbow and the downward sloping pipe portion leading gases into the collecting main. A typical scraper device is shown and described in U.S. Pat. No. 3,480,514. Another device, shown and described in U.S. Pat. No. 3,841,977, employs a blast of air to remove the encrusted matter.

U.S. Pat. No. 3,480,514 describes a first ram, from which a piston rod extends, that carries a circular cleaning head. The ram is pivotable from an almost upright, inoperative position to a downward-sloping operative position by means of a fluid actuated second ram. In the operative position, the first ram advances the rod and a circular cleaning head into the elbow and the downward-sloping pipe portion. The cleaning head is then reciprocated in the pipe portion and elbow to effectively remove any carbon or other deposited matter on the inner wall of the elbow and pipe.

After the cleaning head has been reciprocated several times, to remove the carbon or other depository matter, the first ram retracts the cleaning head and the second ram pivots the cleaning head upward to the inoperative position.

It should be noted that the apparatus of U.S. Pat. No. 3,480,514 does not clean the vertical ascension or standpipe, nor does it use water sprays to remove carbon or other depository matter like the present invention to be described hereinafter.

U.S. Pat. No. 3,841,977 includes a telescopic rod, mounted on a support positioned above an ascension pipe of a coke oven battery, which is arranged to move longitudinally along the top of the coke oven battery. The telescopic rod supports a cleaning tool at one end that can be inserted and reciprocated and rotated in the ascension pipe. The means for rotating the cleaning tool is a gear and pinion combination. A blower is provided on a platform alongside the telescopic rod and it supplies air to the cleaning tool which has a plurality of radial perforations in it.

In contrast to the mechanical scraper-type of cleaner shown and described in U.S. Pat. No. 3,480,514, the present invention describes and claims a cleaning apparatus that uses high pressure water sprays; the water being carried in a flexible hose which is supported by a flexible chain cooperating with pivotable sprockets on a movable carriage.

Also, in contrast to the pneumatic cleaning tool of U.S. Pat. No. 3,841,977, the present invention describes and claims a high pressure water jet cleaning tool and pivotable supporting structure for a flexible hose carrying such water to the reciprocable spray nozzles.

SUMMARY OF THE INVENTION

Apparatus for cleaning the inner surface of an ascension pipe or standpipe of a coke oven chamber comprises a carriage that is movable along the top of a coke oven battery in proximate relation to the ascension pipes. A first pivotable support member is mounted to the carriage, and, in spaced apart relation thereto, a second pivotable support member is also mounted to the carriage. Flexible means, having one end anchored to the carriage, coacts with the first and second pivotable support means, and carries on the other end a nozzle block to which is mounted at least one fluid nozzle. A fluid carrying conduit is supported by the flexible means, and is connected to the nozzle block. Fluid carried by the conduit is supplied to the nozzle under pressure. Means is provided for pivoting the first pivotable means relative to the carriage so as to position the nozzle block and nozzle above a selected ascension pipe. Means is provided for raising and lowering the nozzle block and nozzle in the ascension pipe and for withdrawing the same from the ascension pipe.

For a further understanding of the invention and for features and advantages thereof, reference may be made to the following description and the drawings which illustrate a preferred embodiment of equipment in accordance with the present invention.

DETAILED DESCRIPTION

Figure 1:
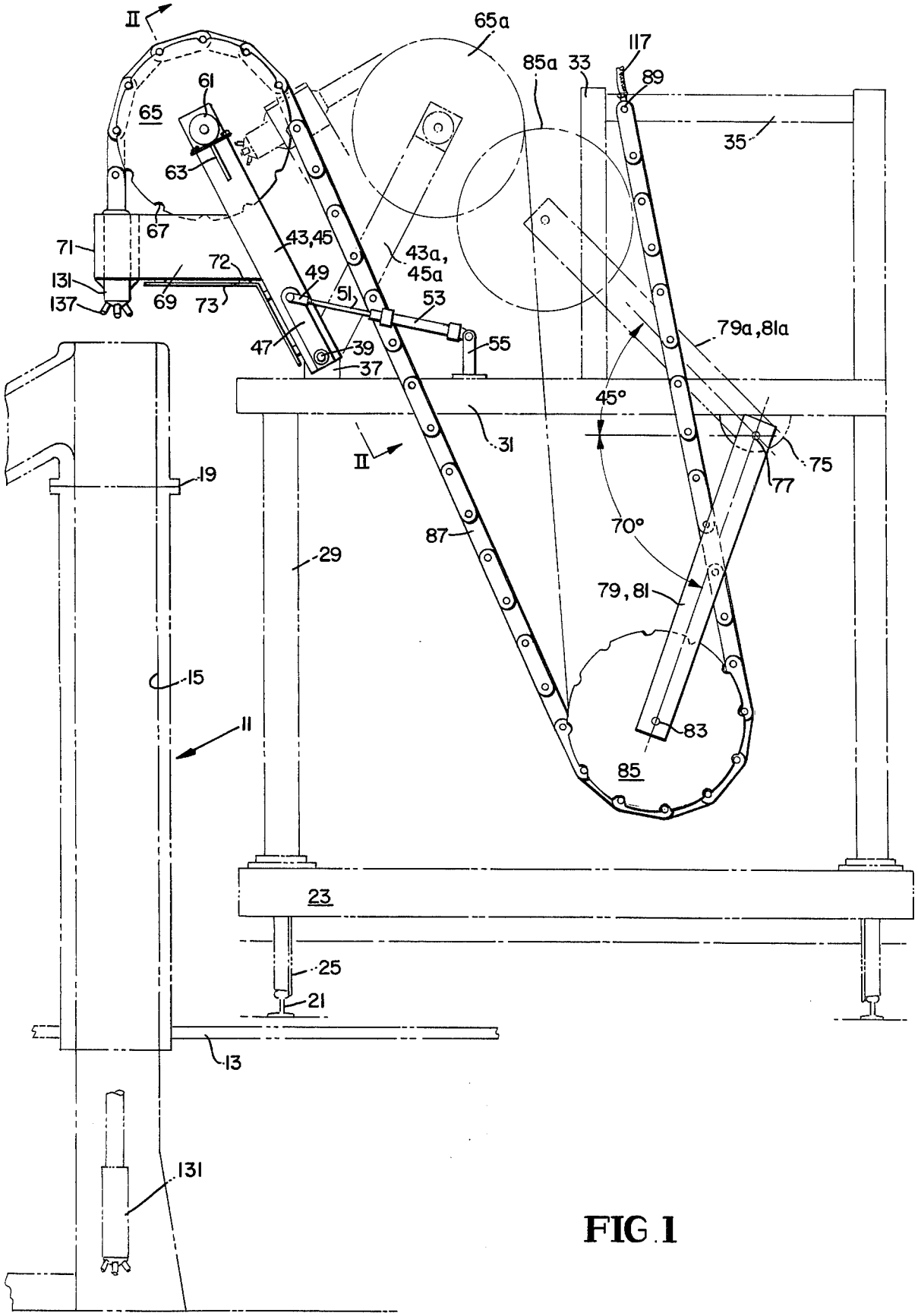
FIG. 1 is a schematic elevational view of a portion of a coke oven battery showing apparatus in accordance with the invention.

Referring to FIG. 1 initially, a conventional form of ascension pipe or standpipe 11 is shown extending upwardly above the top of a coke oven battery 13. The ascension pipe or standpipe 11 is lined with refractory material 15, and at the top, it carries a conventional gooseneck elbow 17, shown partially, that is flange connected, as at 19, to the top of the ascension pipe or standpipe 11.

Supported on rails 21, attached to the top of the coke oven battery 13, is a movable service car or carriage 23 having wheels 25 coacting with the rails 21 on the top of the battery 13.

The service car or carriage 23 has a lower platform bed portion 27 to which are mounted columns 29 that support an upper platform bed portion 31.

On the right-hand side (as viewed in FIG. 1) of the upper platform bed portion 31 there are shown other columns 33 to which is attached at the top thereof a horizontal support beam 35 of a small top platform.

On the left-hand side (as viewed in FIG. 1) of the upper platform bed portion 31 there are lugs 37 which are supports for a shaft 39. The shaft 39 is suitably connected as at 41 to a pair of arms 43, 45. The shaft 39 extends outwardly from arm 45 and carries on its end a lever 47 that is pivotally connected to a clevis 49 of piston rod 51. The piston rod 51 is part of a cylinder-piston assembly 53 mounted pivotally to a support 55 fixed on the upper platform bed portion 31.

Figure 2:
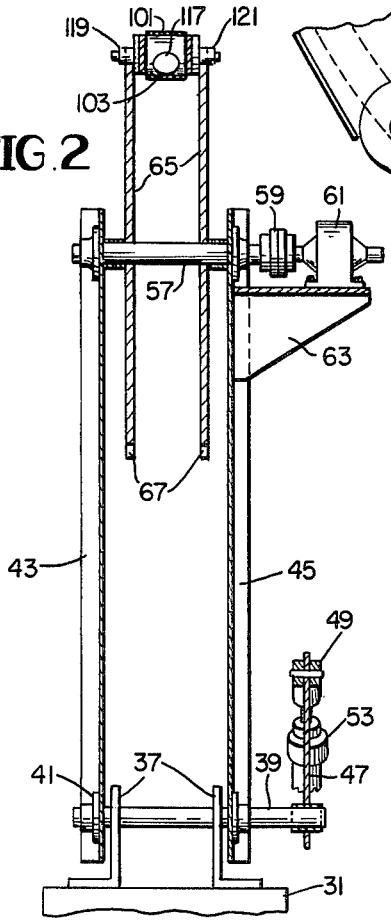
FIG. 2 is a view along line II—II of FIG. 1.

As shown in FIGS. 1 and 2, the upper ends of the arms 43, 45 support another shaft 57 which is coupled, as at 59, to an hydraulic motor 61. The hydraulic motor 61, as shown, is mounted on a platform 63 carried by arm 45. Of course, other types of means for producing rotary motion may be used if preferred.

As shown in FIGS. 1 and 2, the shaft 57 carries a spaced-apart pair of sprockets 65 which have a plurality of angularly spaced-apart, perimetrical notches or grooves 67 adapted to receive cylindrical rollers 119, 121 referred to hereinafter.

Extending outwardly from the arms 43, 45, as shown in FIG. 1, are a pair of support arms 69 that support, at their outer ends, a cylindrical tubular housing 71. Secured to lugs 72 on the bottom surfaces of the arms 69 and the arms 43, 45, is a formed heat shield 73 that is bent, as shown, to keep heat away from the lower portion of the arms 43, 45 and the lever 47 and cylinder-piston assembly 53 when the apparatus is positioned operatively, as shown in FIG. 1, over the open ascension pipe 11.

The upper platform bed portion 31 supports on its underneath side, about where shown in FIG. 1, a pair of spaced-apart lugs 75, similar to the lugs 37. Journaled to these lugs is a shaft 77 to which are mounted spaced apart arms 79, 81. The other ends of arms 79, 81 carry a shaft 83, like shaft 57, to which is fixed a pair of spaced-apart sprockets 85 that are practically identical to the sprockets 65.

Looped around the sprockets 85 and 65 is a length of chain 87 which is secured to an anchor point 89 on the cross beam 35, as suggested in FIG. 1.

Figure 4:
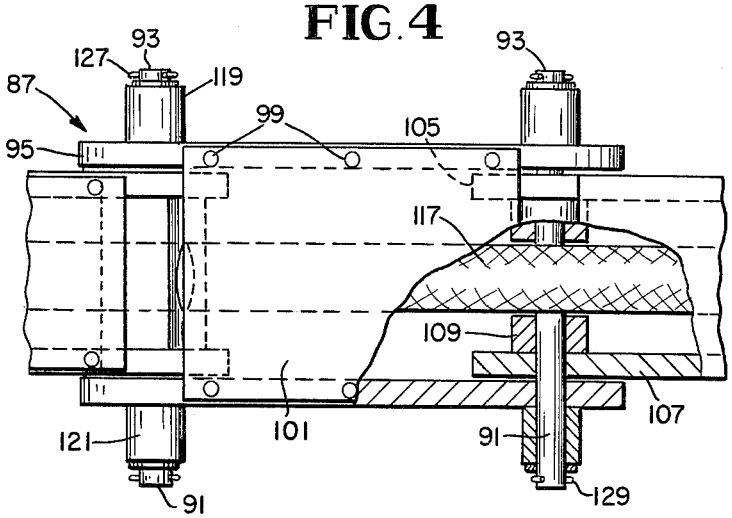
FIG. 4 is a view along line IV—IV of FIG. 3.
Figure 5:
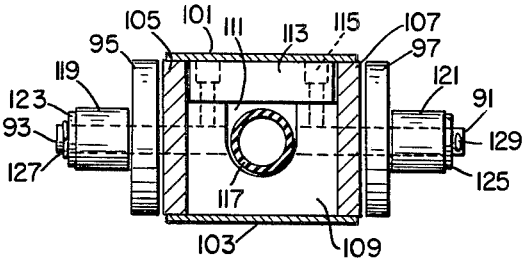
FIG. 5 is a view along line V—V of FIG. 3.
Figure 6:
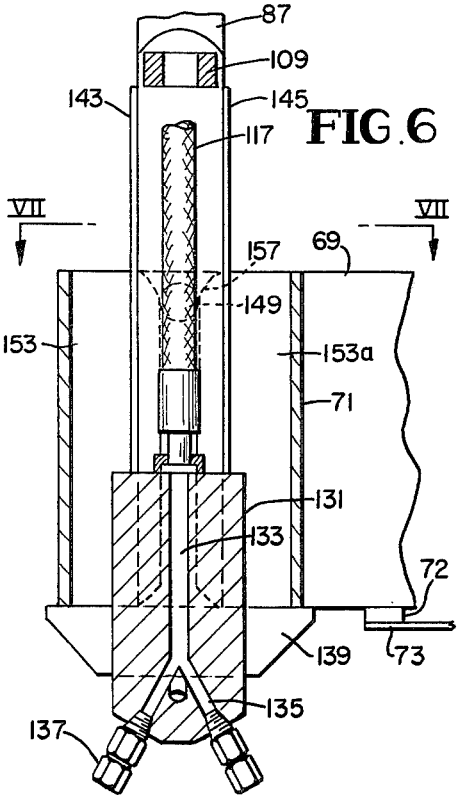
FIG. 6 is a view, partly in section of a nozzle assembly in accordance with the invention.

FIGS. 4–6 illustrate one form the chain 87 of the invention may assume. The chain 87 comprises a plurality of links that are connected at their respective ends by means of pins 91, 93. As shown in FIGS. 4 and 5, each link of the chain 87 includes spaced-apart side members 95, 97 to which are bolted, as at 99, top and bottom cover plates 101, 103. The pins 91, 93 extend transversely of the link and through side members 105, 107 of joining links, and are welded into a hose-supporting block 109, having a U-shaped groove 111 in it, that is disposed between the side members 105, 107. A keeper 113 in the form of a transverse bar is removably bolted, as at 115, to the block 109 allowing for the easy removal, when necessary or desirable, of a flexible fluid conduit or hose 117.

The outward extending portion of each pin 91, 93 supports a roller 119, 121 journaled thereon. The rollers 119, 121 are suitably removably secured to the pins 91, 93 by washers 123, 125 and cotter pins 127, 129. Each roller is adapted by size to cooperate with the grooves or notches 67 in the sprockets 65 and 85.

FIG. 6 illustrates a nozzle assembly 130 that includes a nozzle block 131 having a central axial passage 133 therein that merges with one or more (four are shown in the preferred embodiment of the invention in the drawings) diverging passages 135 into which spray nozzles 137 are threaded and secured.

The nozzles 137 may be any suitable nozzle, but a suitable nozzle is one that produces a 30° flat fan-spray pattern.

Attached to the nozzle block 131, as shown in FIG. 6, are oppositely disposed, generally triangular stop bars 139 that coact with the housing 71 when the nozzle block 131 is not in operative use, and for reasons that will become apparent from the further description hereafter.

Connected to the top of the nozzle block 131 in any suitable manner, as by welding, are spaced apart, upwardly extending flat bar members 141 that connect, as suggested, to one end of a link in the chain 87. The flat bar members 141 are provided with cover plates 143, 145 which are similar to the top and bottom cover plates 101, 103 described previously herein and shown in FIGS. 6 and 7.

Figure 7:
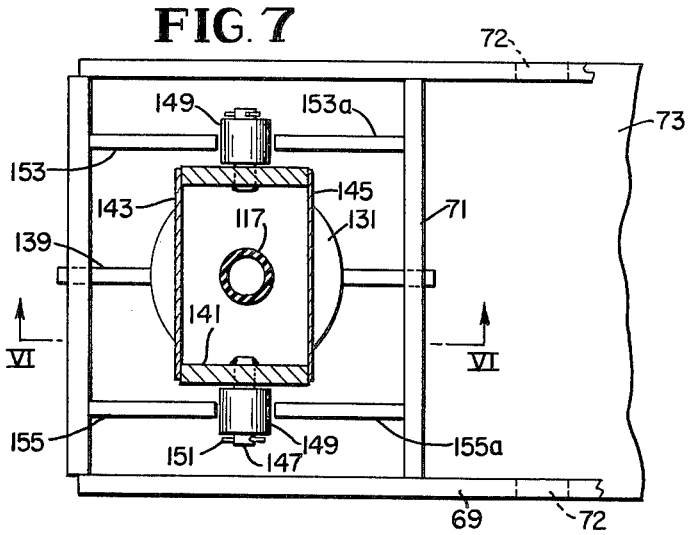
FIG. 7 is a cross-sectional view along line VII—VII of FIG. 6.

FIG. 7 is a view along line VII—VII of FIG. 6, and FIG. 7 shows a line VI—VI along which the view of FIG. 6 is taken. In FIG. 7, the flat bar member 141 are each provided with an outwardly projecting stub shaft 147, that is fixed to the flat bar members 141, as by welding, or in any other suitable manner. Each stub shaft 147 carries a roller 149 that is held thereon by a cotter pin 151 in the same way the rollers 119, 121 are held to the shafts 91, 93.

Figure 3:
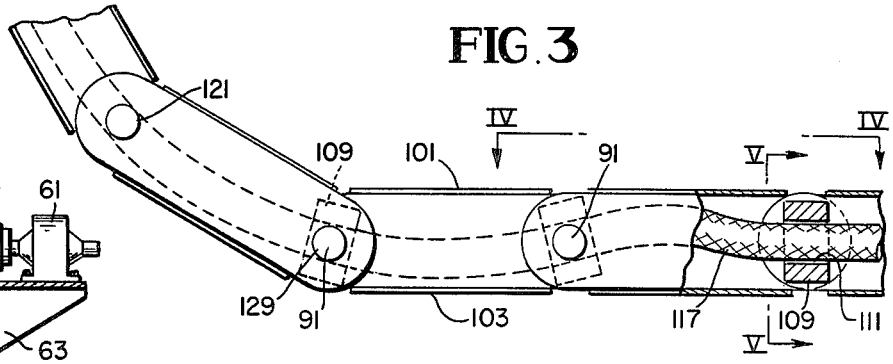
FIG. 3 is an elevational side view of a portion of a chain in accordance with the invention.

The housing 71 is provided internally with two sets of spaced-apart, guide bars **153, 153*a* and 155, 155*a*. The guide bars of each set 153, 153*a* and 155, 155*a* are disposed in spaced apart relation just far enough to readily receive and coact with one of the rollers 149; the top opposing corners of each guide bar 153, 153*a* and 155, 155*a* being rounded, as at 157, shown in FIG. 3, for easy entry of the rollers 149 into the space between the guide bars 153, 153*a* and 155, 155*a***.

Associated conventional equipment that is used with the apparatus of the present invention, but which is not shown or described, may include: fluid pump, fluid storage tank, pipes, valves and necessary fittings and control equipment, that would be known to one skilled in the art.

In operating the high pressure water cleaning apparatus of the present invention, an operator located at a control console would first actuate the hydraulic cylinder-piston assembly 53 to move the upper pair of pivoted sprockets 65 from the stowed, inoperative position 65*a*, to the operative position shown in solid line form in FIG. 1. As the arms 43, 45 rotate, they actuate a rotary cam limit switch (not shown) that energizes a signal when the housing 71 and the nozzle block 131 are axially spotted above the ascension pipe 11. While the upper pair of sprockets 65 are pivoting as described, the lower pair of sprockets 85, being unrestrained and freely pivotable with the supporting arms 79, 81, also assume a location just above where shown in solid outline form in FIG. 1. The chain 87 is of fixed length and one end is fixed, as at 89, so that the lower sprockets 85 must be free to move relative to the movable upper sprockets 65.

When the housing unit 71 and the nozzle block 131 are positioned axially with respect to the ascension pipe 11, the operator actuates the pumping unit and, after a short delay to allow the pressure to build up in the water system, actuates the hydraulic drive motor 61 to lower the spray head or nozzle block into the ascension pipe.

The pumping unit would be capable of delivering 20 gallons per minute (7.57 liters per minute) of water at about 5000 pounds per square inch (351.5 kilograms per square centimeter) pressure. The operating pressure may, however, vary from 1,000 to 10,000 psi (70.31 to 703.1 kg/cm$^2$) as necessary for effectively cleaning the ascension pipe.

A suitable water storage tank for use with the apparatus of the present invention should have a capacity of about 400 gallons (1514 liters), and such a tank should be located so that it can be easily refilled from a stationary fill valve at either end or at both ends of the battery, preferably on the movable carriage.

Piping and valving for use with the equipment of the invention should be stainless steel, and should be suitable for use at pressures in the range mentioned previously herein. The hose that carries high pressure water to the nozzle block may be six wire braid reinforced hose having an inside diameter of three-quarters of an inch (1.91 cm). A spring loaded check valve of suitable manufacture should be installed immediately upstream of the nozzle block to prevent dripping from the nozzles after flow of water has been shut off when a cleaning operation terminates.

From the foregoing description of one embodiment of the invention, those skilled in the art should recognize many important features and advantages of it, among which the following are particularly significant:

That the apparatus and its method of use are simple and adaptable to existing, as well as new, coke oven batteries that have vertical ascension pipes with gooseneck elbows that have a vertical passageway communicating with such ascension pipes;

That the apparatus of the invention is effective in removing carbonaceous depository material on the refractory lining of an ascension pipe; and That the apparatus of the invention can be easily and quickly serviced and maintained for continuity of service.

According to the provisions of the patent statutes, the principle, preferred construction and mode of operation of the present invention have been explained and what is now considered to represent its best embodiment has been illustrated and described. However, it is to be understood that, within the scope of the appended claims, the invention may be practiced otherwise than as specifically illustrated and described.

What is claimed is:

1. In a coke oven battery comprising coke oven chambers having at least one ascension pipe for each such chamber, an improved apparatus for cleaning the inner surfaces of said ascension pipes, comprising:

a. a carriage movable along the top of said coke oven battery in proximate relation to said ascension pipes;

b. first pivotable support means mounted to said carriage;

c. second pivotable support means mounted to said carriage in spaced apart relation to said first support means;

d. flexible carriage means anchored at one end to said carriage and said flexible carriage means adapted to be carried by and guided by said first support means and said second support means;

e. fluid conduit means operably connected to and supported by said flexible carriage means;

f. at least one spray means connected to said fluid conduit means, said spray means adapted to receive fluid under pressure from said fluid conduit means and said fluid emerging from said spray means to impinge on the inner surface of said selected ascension pipe and wash away encrusted matter thereon;

g. means connected to said first pivotable support means for pivoting it away from and toward said ascension pipes whereby at least one spray means is positionable above a selected one of said ascension pipes; and h. means acting upon said flexible carriage means for lowering and raising said at least one spray means and said conduit means in and out of said selected ascension pipe.

2. The invention of claim 1 wherein:

a. said first pivotable support means is an arm pivotally mounted at one end to said carriage and carrying a rotatable member at the other end of said arm;

b. said second pivotable support means is an arm pivotally mounted at one end to said carriage and carrying a rotatable member at the other end of said arm; and c. said flexible means is a chain that coacts with said rotatable members.

3. The invention of claim 2 wherein:

a. said fluid carrying conduit is a flexible hose that is supported by said chain and that carries water under pressure to said at least one nozzle.

4. The invention of claim 1 further comprising:

a. engaging means, connected to said first pivotable support means, which engages and holds said spray carrying means when said spray carrying means is inoperative.

5. The invention of claim 4 wherein:

a. said engaging means includes guide bars disposed inside of said means; and further comprising b. guide means, on said spray carrying means, that cooperate with said guide bars and position said spray carrying means within said engaging means; and c. stop means, on said spray carrying means, for preventing said spray carrying means from passing through said engaging means.

6. In a coke oven battery comprising coke oven chambers having at least one ascension pipe for each such chamber, an improved apparatus for cleaning the inner surfaces of said ascension pipe, comprising:

a. a carriage that is movable along the top of said coke oven battery in proximate relation to said ascension pipes;

b. a first arm pivotally mounted, at one end, to said carriage;

c. a second arm pivotally mounted, at one end, to said carriage and disposed in spaced apart relation to said first arm;

d. sprockets rotatably mounted, one each to said first and second arms, to the second ends of said first arm and said second arm;

e. a chain anchored at one end to said carriage and cooperating with said sprockets;

f. nozzle carrying means connected to the other end of said chain;

g. a plurality of spray nozzles mounted to said nozzle carrying means;

h. fluid carrying flexible conduit communicating with said nozzles for delivering water thereto, said conduit being supported by said chain;

i. cylinder-piston means secured to said carriage and to said first arm for pivoting said first arm and sprocket mounted thereon away from and toward said ascension pipes so that said nozzle carrying means and said nozzles are positionable above each selected ascension pipe;

j. power means for rotating one of said sprockets to raise and lower said nozzle carrying means and said nozzles into said ascension pipe and out of said ascension pipe; and k. means connected to said first arm for retarding movement of said nozzle carrying means when said nozzle carrying means is inoperative.

7. The invention of claim 6 further comprising:

a. guide bars in said means on said first arm; and b. means on said nozzle carrying means that operably engage said guide bars for holding said nozzle carrying means inoperatively in said means on said first arm.

* * * * *